US011486676B2

(12) United States Patent
Noonan et al.

(10) Patent No.: US 11,486,676 B2
(45) **Date of Patent: *Nov. 1, 2022**

(54) REAR SIGHT ASSEMBLY

(71) Applicant: Brownells Inc, Montezuma, IA (US)

(72) Inventors: Paul T. Noonan, Boise, ID (US); Paul Levy, Montezuma, IA (US)

(73) Assignee: Brownells, Inc, Montezuma, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/011,489

(22) Filed: Sep. 3, 2020

(65) Prior Publication Data

US 2020/0400405 A1 Dec. 24, 2020

Related U.S. Application Data

(63) Continuation of application No. 16/250,022, filed on Jan. 17, 2019, now Pat. No. 10,801,810.

(51) Int. Cl.
*F41G 1/26* (2006.01)
*F41G 1/08* (2006.01)

(52) U.S. Cl.
CPC ..... *F41G 1/26* (2013.01); *F41G 1/08* (2013.01)

(58) Field of Classification Search
CPC ..... F41G 1/08; F41G 1/10; F41G 1/12; F41G 1/16; F41G 1/18; F41G 1/20; F41G 1/22; F41G 1/24; F41G 1/26; F41G 1/28
USPC ..... 42/136
See application file for complete search history.

(56) References Cited

U.S. PATENT DOCUMENTS 10,801,810 B2 * 10/2020 Noonan ..... F41G 1/26

* cited by examiner

*Primary Examiner* — Bret Hayes

(57) ABSTRACT

A rear sight assembly is disclosed. The rear sight assembly contains a housing defining a first opening, a second opening, and a third opening, a rear sight mechanism containing a thumb wheel positioned in the first opening, at least partially threaded support member positioned in the second opening and the third opening, wherein the at least partially threaded support member is threaded through the thumb wheel, and a rear aiming point member adjustably coupled with the at least partially threaded support member.

6 Claims, 17 Drawing Sheets

REAR SIGHT ASSEMBLY

CROSS REFERENCE TO RELATED APPLICATIONS

This application claims the benefit of U.S. Provisional Application No. 62/619,188, filed on Jan. 19, 2018, which is incorporated herein by reference in its entirety. This application is a continuation of U.S. patent application Ser. No. 16/250,022 titled "Rear Sight Assembly" filed Jan. 17, 2019, now issued U.S. Pat. No. 10,801,810, which is incorporated herein by reference in its entirety.

FIELD

The present invention relates to firearms. More particularly, the present invention relates to a rear sight assembly for a firearm.

BACKGROUND

To provide increased accuracy, firearms known in the art are equipped with a front sight system 1 and a rear sight system 2 as shown in FIG. 1. By aligning front and rear sights, the direction of a fired bullet can be more accurately predicted. As is known, however, a particular setting of the sighting system is only accurate for a particular range of distances because a bullet drops as it travels forward due to the effects of gravity. When the sights are non-adjustable, they must be aimed further and further above the intended target as the distance to the target increases, making the firearm more difficult to accurately aim. This is especially problematic when attempt to aim at distant targets if the sights accurately predict the bullets trajectory at shorter distances, for a user may have to aim far enough above the target so as to make it difficult to determine if the sights are actually aligned with the target. Therefore, there exists a need for an improved sight.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to dearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
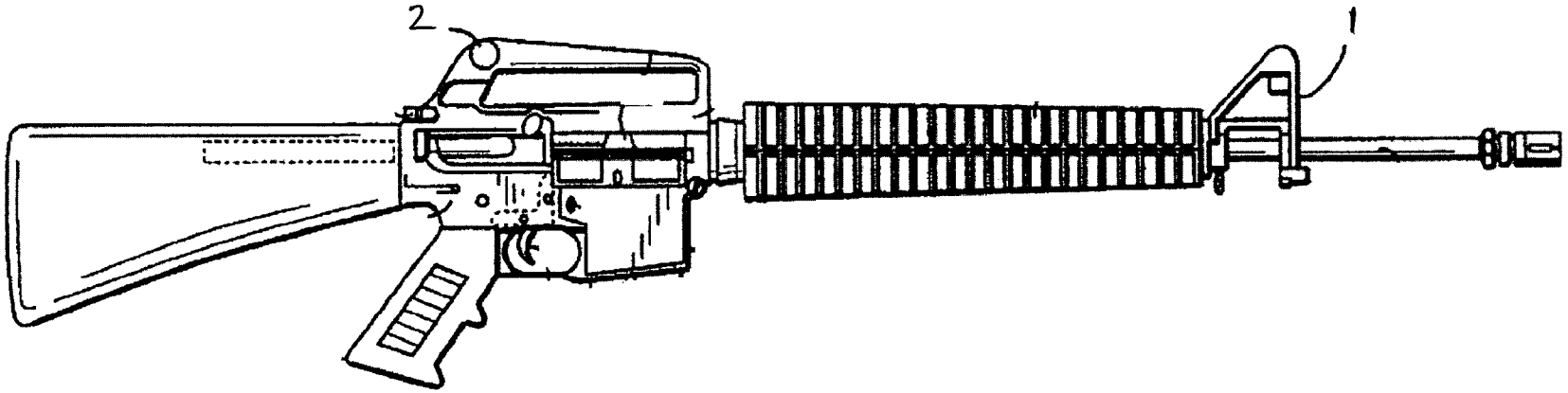
Figure 1 PRIOR ART
FIG. 1 depicts a forearm as known in the art.
Figure 2A:
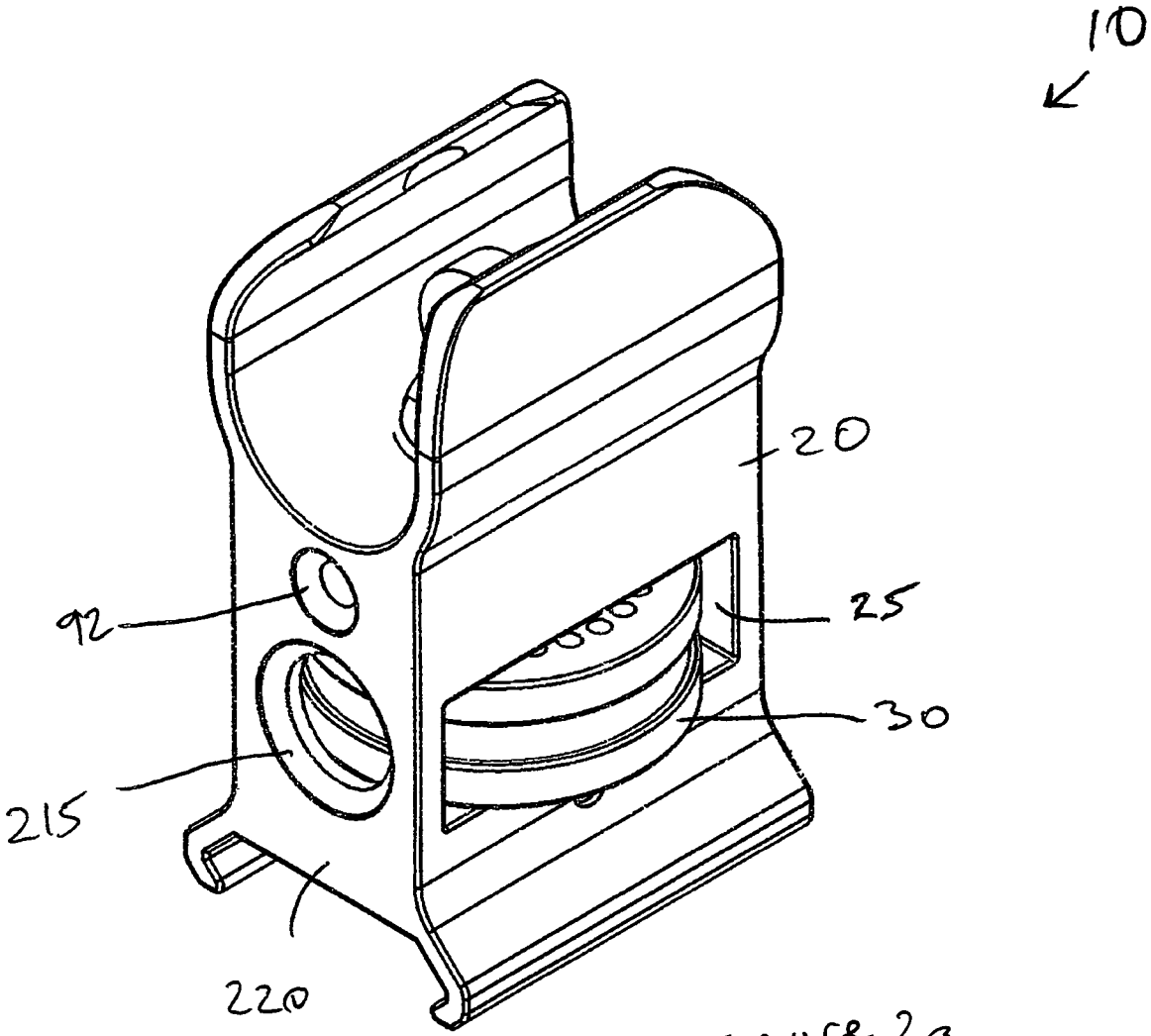
FIG. 2*a* depicts a perspective view of a rear sight assembly according to some embodiments presently disclosed.
Figure 2B:
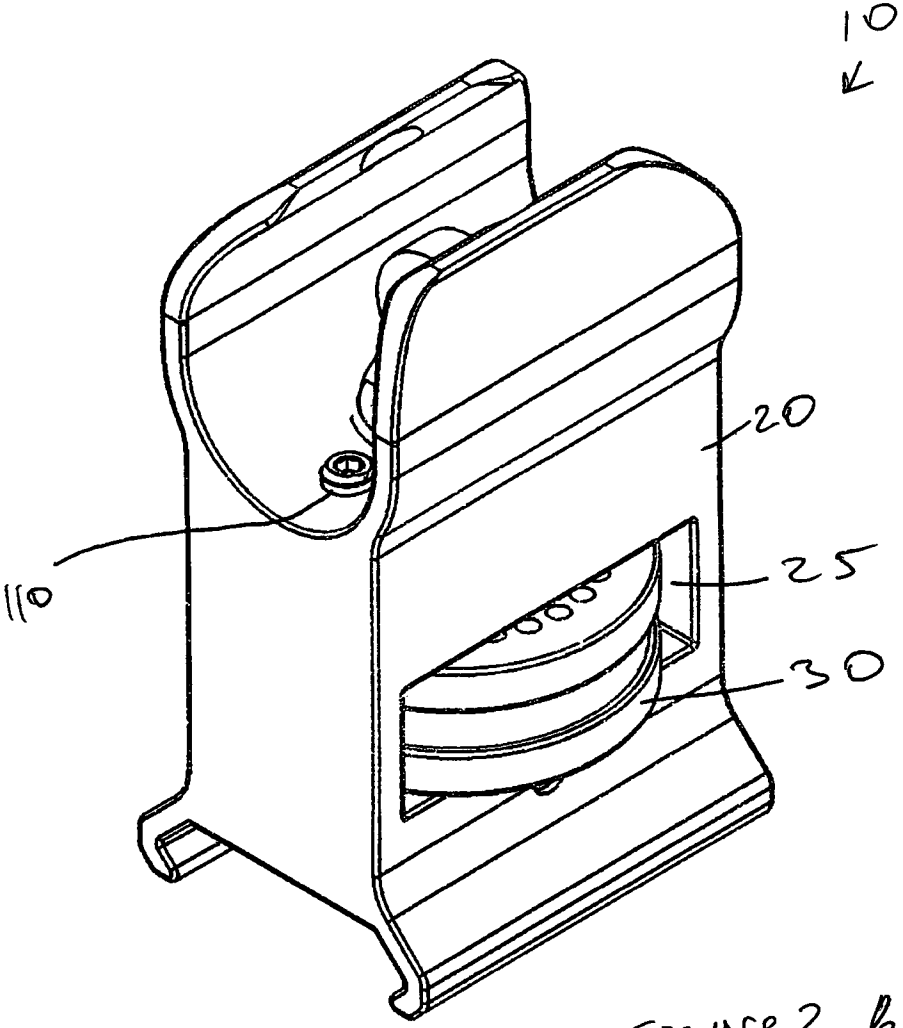
FIG. 2*b* depicts another perspective view of the rear sight assembly shown in FIG. 2*a*.
Figure 3:
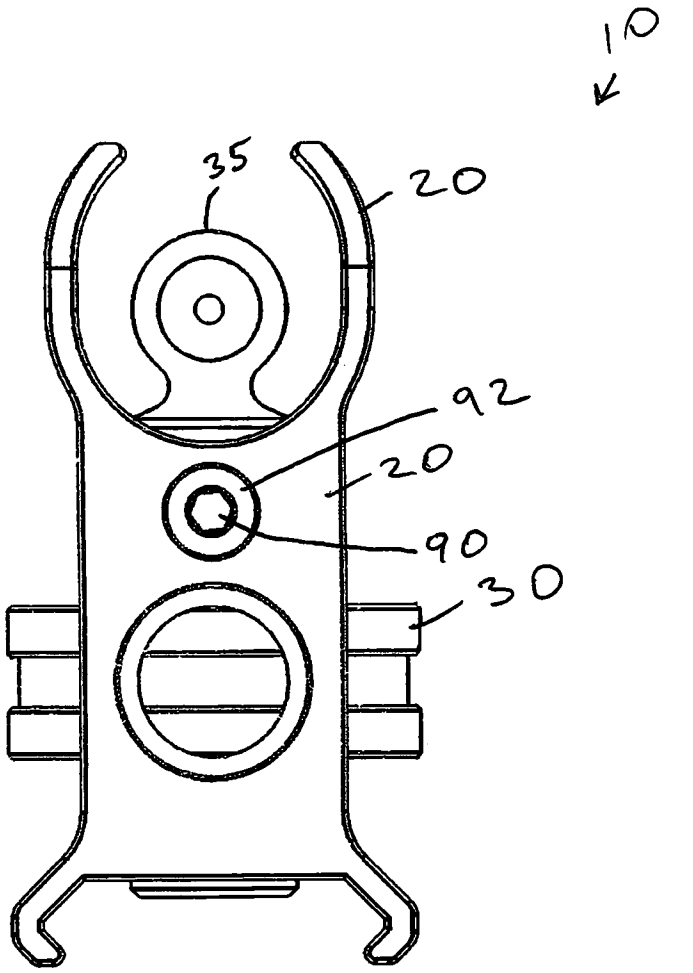
FIG. 3 depicts a front view of the rear sight assembly shown in FIG. 2*a*.
Figure 4:
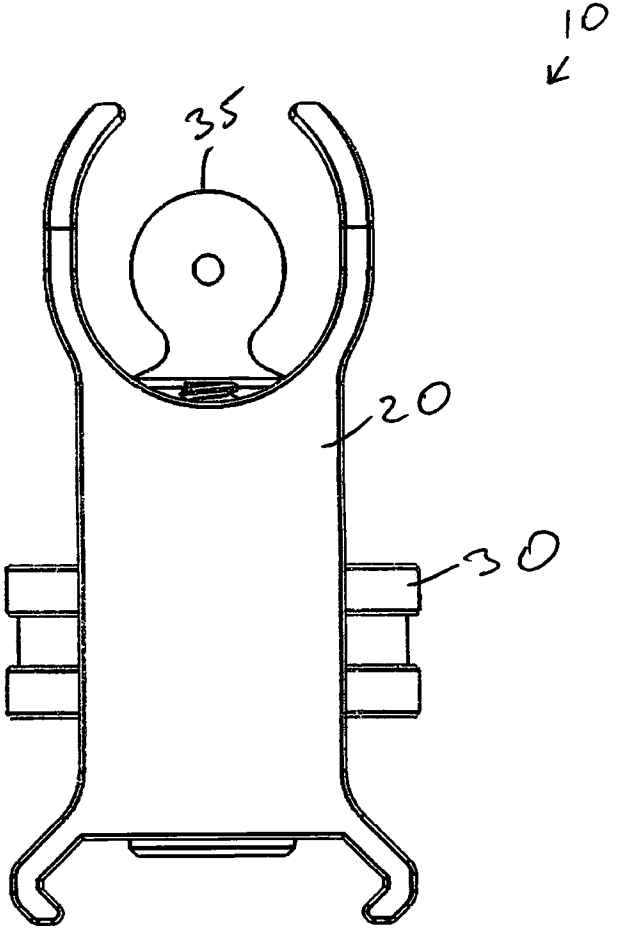
FIG. 4 depicts a rear view of the rear sight assembly shown in FIG. 2*a*.
Figure 5:
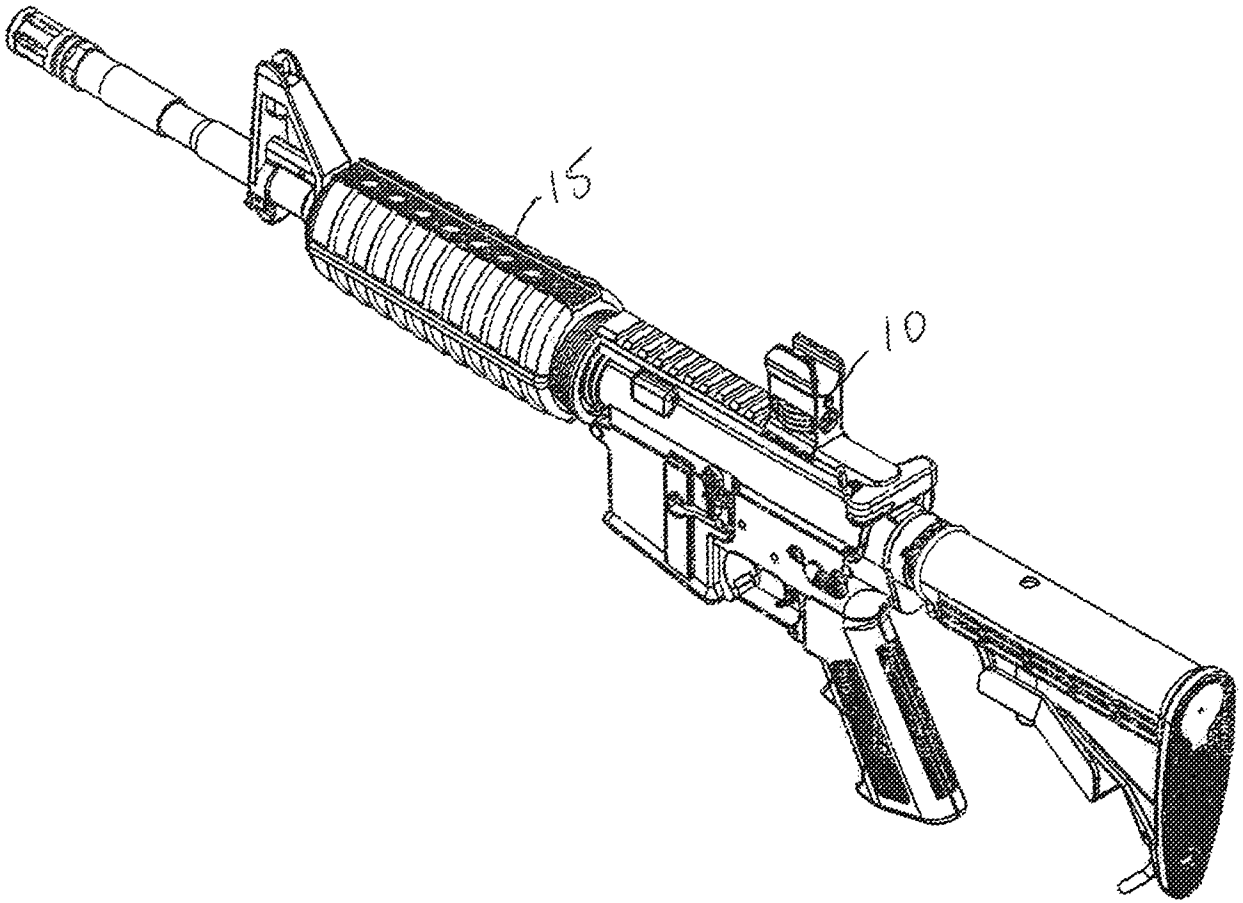
FIG. 5 depicts a rear perspective view of a firearm with the rear sight assembly according to some embodiments presently disclosed.
Figure 6:
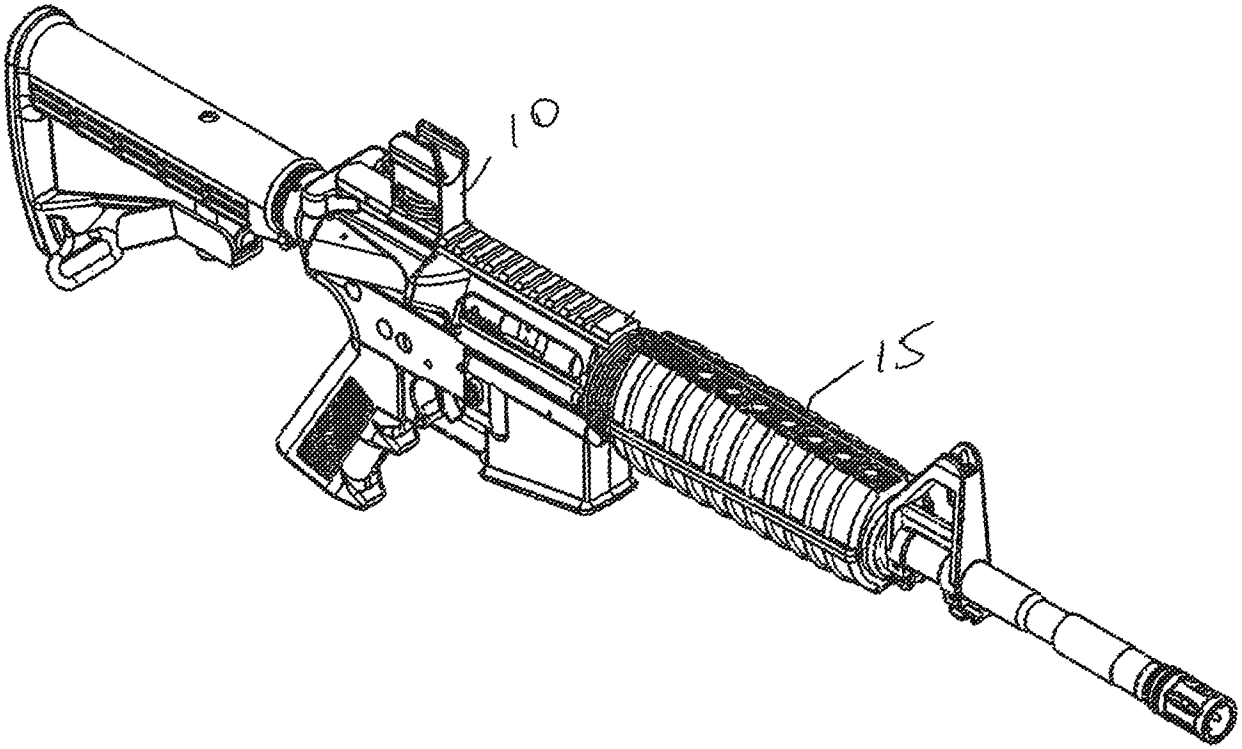
FIG. 6 depicts a front perspective view of the firearm shown in FIG. 5.

Referring to FIGS. 2*a*-4, a rear sight assembly 10 is shown according to the present disclosure. The rear sight assembly 10 can be permanently or removably mounted to a firearm 15 as shown in FIGS. 5-6.

The rear sight assembly 10 comprises a housing 20 (shown in FIGS. 2*a*-4 and 14) and a rear sight mechanism 22 (shown in FIGS. 8-11). The rear sight mechanism 22 comprises a threaded thumb wheel 30, a rear aiming point member 35, and at least partially threaded support member 40.

The housing 20 defines a first opening 25 (shown in FIGS. 2*a*-*b*) that is sized and shaped to accommodate the threaded thumb wheel 30. The housing 20 further defines a second opening 60 (shown in FIG. 14) and a third opening 65 (shown in FIG. 7) both sized and shaped to accommodate the threaded support member 40. The threaded thumb wheel 30 comprises threaded opening 32 (shown in FIG. 7) configured to engage the at least partially threaded support member 40 (shown in FIG. 8).

According to some embodiments presently disclosed, when the threaded thumb wheel 30 is placed in the first opening 25, the threaded support member 40 is placed through the second opening 60 until it engages the opening 32 of the thumb wheel 30. According to some embodiments presently disclosed, by rotating the thumb wheel 30, the support member 40 is threaded through the opening 32 into the third opening 65. By rotating the thumb wheel 30, the height of the rear aiming point member 35 can be adjusted and the firearm 15 can be sighted in for the desired range because the adjustment of the rear sight affects the orientation of the firearm with respect to the target, and therefore modifies the trajectory of the bullet relative to the sighting system. According to some embodiments presently disclosed, the threads of the support member 40 and the threaded opening 32 can be configured as ½-28 UNEF-2A MOD and ½-28 UNEF-2B MOD. Such a thread configuration allows for a fifteen degree turn to provide the desired change in angle of the sights.

According to some embodiments presently disclosed, rotating the thumb wheel in the first direction causes the support member 40 to move in an upward direction. According to some embodiments presently disclosed, rotating the thumb wheel 30 in the second direction causes the support member 40 to move in a downward direction. According to some embodiments presently disclosed, the first direction is to the right and the second direction is to the left. According to some embodiments presently disclosed, the first direction is to the left and the second direction is to the right.

According to some embodiments presently disclosed, the second opening 60 may also be threaded and the support member 40 is rotated through the opening 60 to reach the thumb wheel 30.

Positioned below the opening 25 is a pin opening 45 (shown in FIG. 7) for receiving a pin 50 used to secure the rear sight mechanism 22 to the housing 20. The threaded support member 40 comprises an elongated slot 55 sized and shaped to receive the pin 50 that is inserted into the pin opening 45. The elongated slot 55 comprises a top 56 and a bottom 58.

Figure 8:
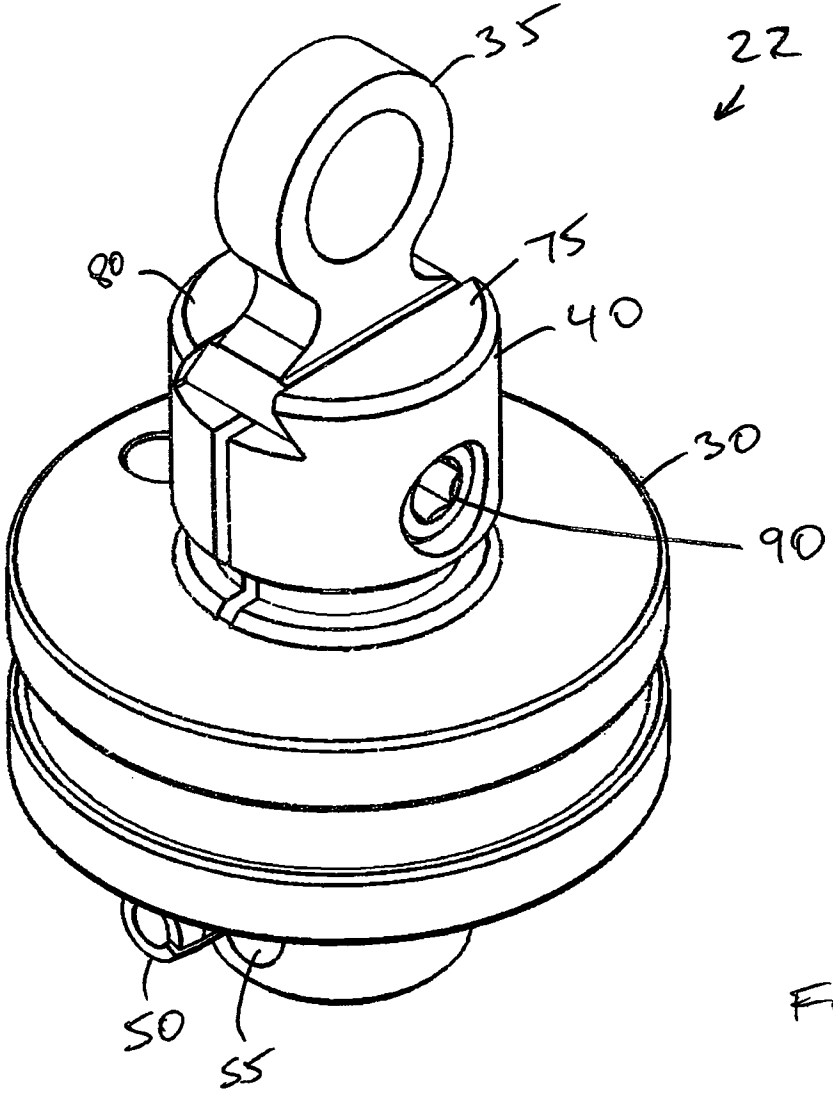
FIG. 8 depicts a perspective view of a rear sight mechanism according to some embodiments presently disclosed.
Figure 9:
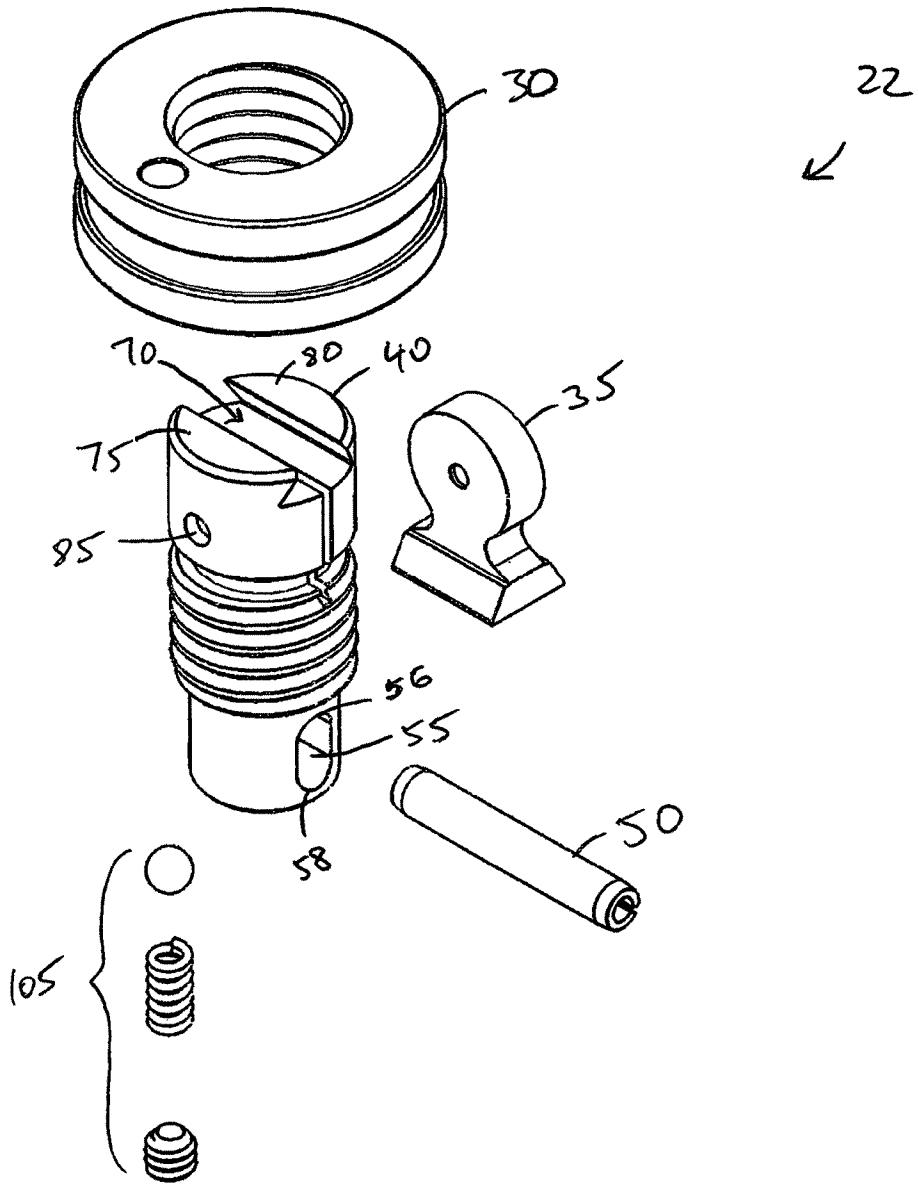
FIG. 9 depicts an exploded view of the rear sight mechanism shown in FIG. 8.
Figure 10:
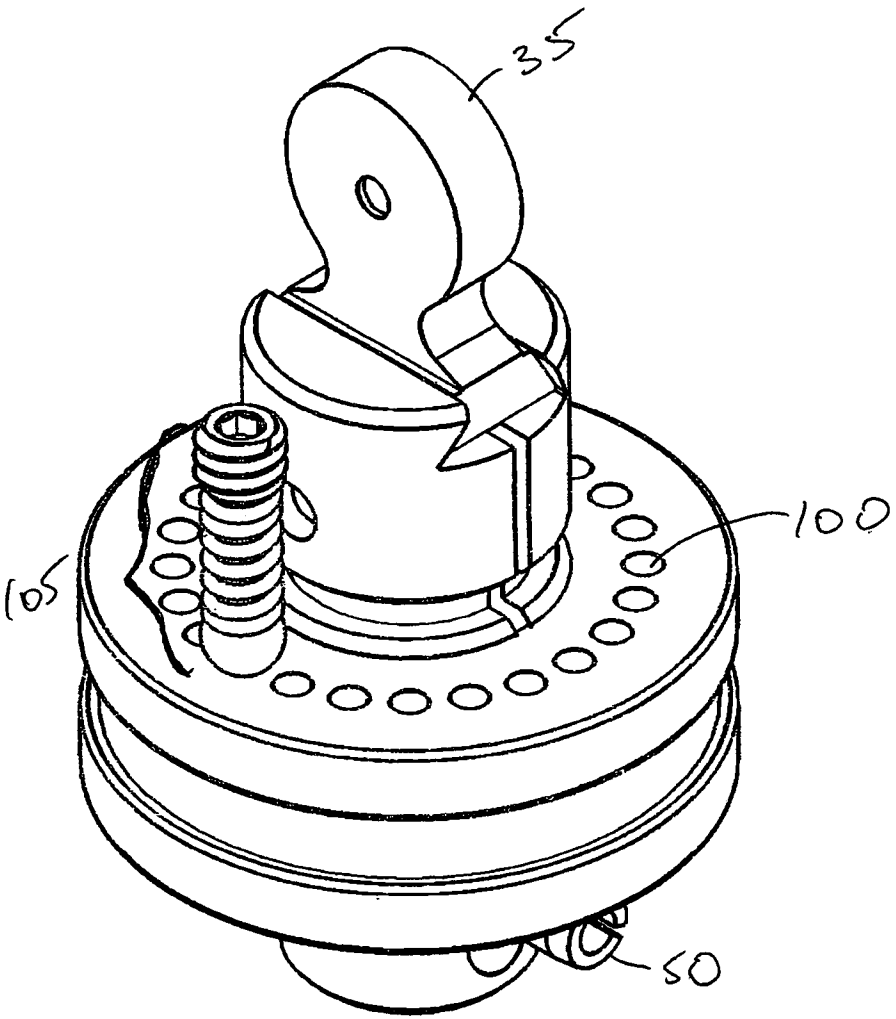
FIG. 10 depicts another perspective view of a rear sight mechanism according to some embodiments presently disclosed.
Figure 11:
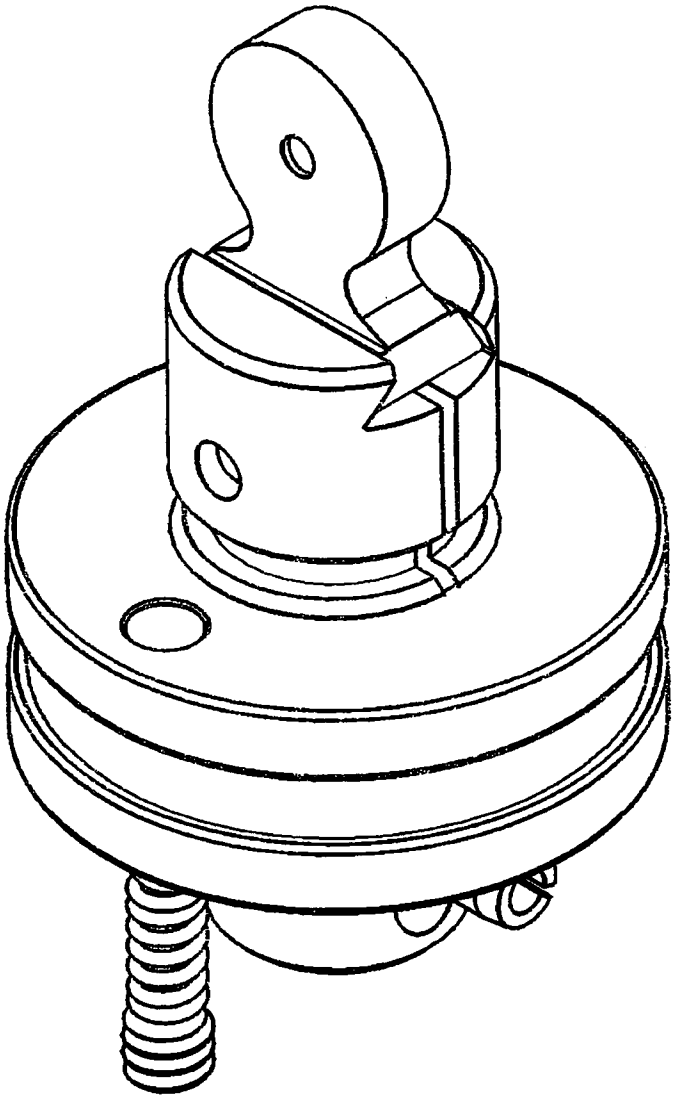
FIG. 11 depicts another perspective view of a rear sight mechanism according to some embodiments presently disclosed.

According to some embodiments presently disclosed, the support member 40 is adjustably coupled with the rear aiming point member 35. According to some embodiments presently disclosed, the support member 40 comprises an adjustable opening 70 (shown in FIG. 9) configured to accommodate the rear aiming point member 35 as shown in FIG. 8. According to some embodiments presently disclosed, the support member 40 comprises a first section 75 and a second section 80 that define the adjustable opening 70. The first section 75 comprises an opening 85 configured to accommodate a fastener 90 and the second section 80 comprises an opening (not shown) configured to accommodate the fastener 90. The fastener 90 may be a pin, a screw, a setscrew, a full dog point set screw, or a dogleg set screw.

According to some embodiments presently disclosed, rotating the fastener 90 in the first direction causes the first section 75 and the second section 80 to move dose together thereby minimizing the opening 70 and preventing the rear aiming point member 40 from moving. According to some embodiments presently disclosed, rotating the fastener 90 in the second direction causes the first section 75 and the second section 80 to move away from each other thereby increasing the opening 70 and allowing the rear aiming point member 40 to move from left to right to compensate for the wind. According to some embodiments presently disclosed, the first direction is to the right and the second direction is to the left. According to some embodiments presently disclosed, the fastener 90 can be accessed through an opening 92 (shown in FIGS. 2*a* and 7) of the frame 20 when the support member 40 is positioned within the second opening 60.

According to some embodiments presently disclosed, the thumb wheel 30 comprises a plurality of holes 100 (shown in FIG. 10) configured to engage a detent 105 that holds the thumb wheel 30 in the desired location until a user rotates it. According to some embodiments presently disclosed, the plurality of holes 100 are positioned on the top surface of the thumb wheel 30 (shown in FIG. 10) and the detent 105 is inserted through the top opening 110 shown in FIG. 2*b*. According to some embodiments presently disclosed, the plurality of holes 100 are positioned on the bottom surface of the thumb wheel 30 (shown in FIG. 11) and the detent 105 is inserted through the bottom opening 115 shown in FIG. 7.

Figure 7:
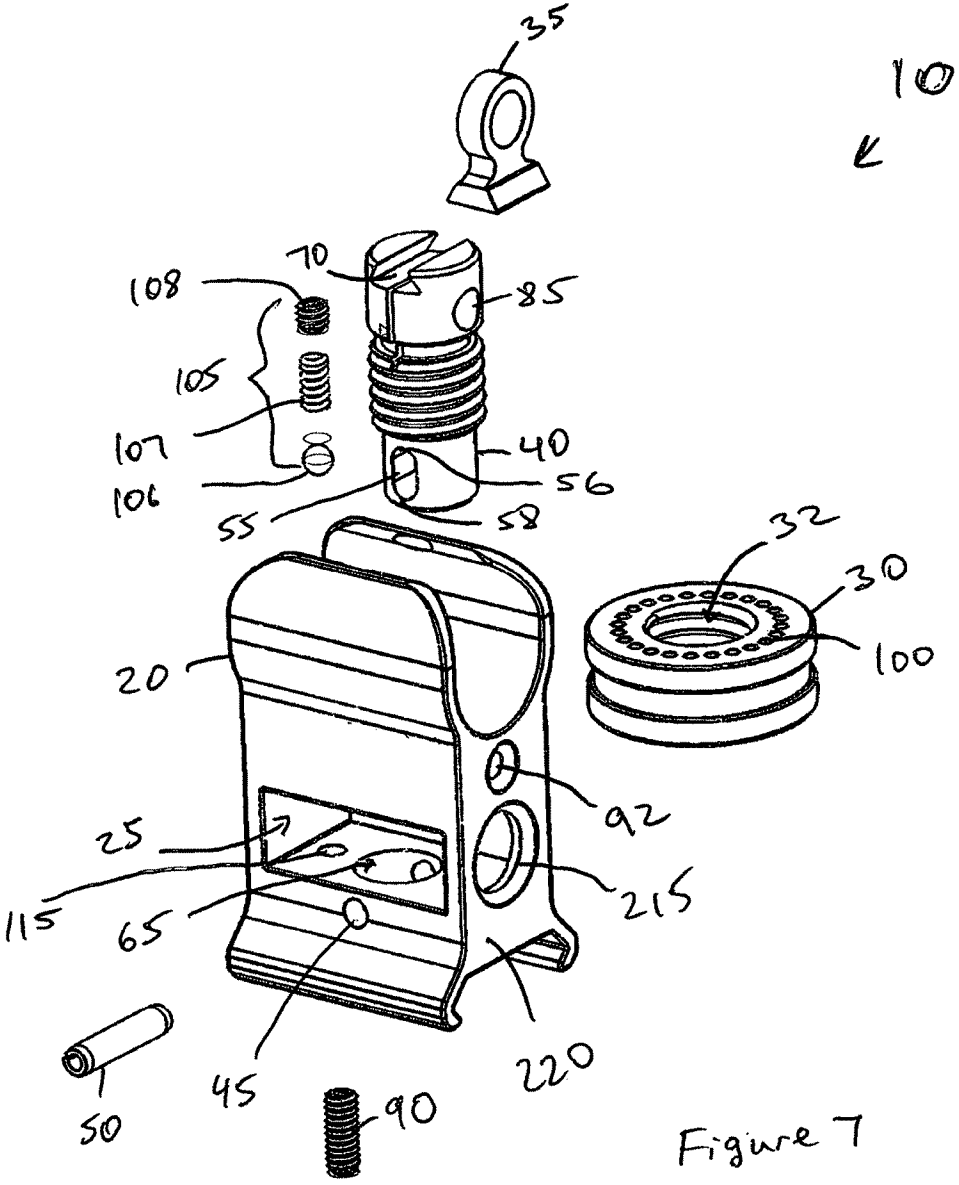
FIG. 7 depicts an exploded view of the rear sight assembly shown in FIG. 2*a*.

According to some embodiments presently disclosed, the detent 105 comprises a ball bearing 106, a spring 107, and a fastener 108 (as shown in FIG. 7). The fastener 108 may be a pin, a screw, a setscrew, a full dog point set screw, or a dogleg set screw.

Figure 12:
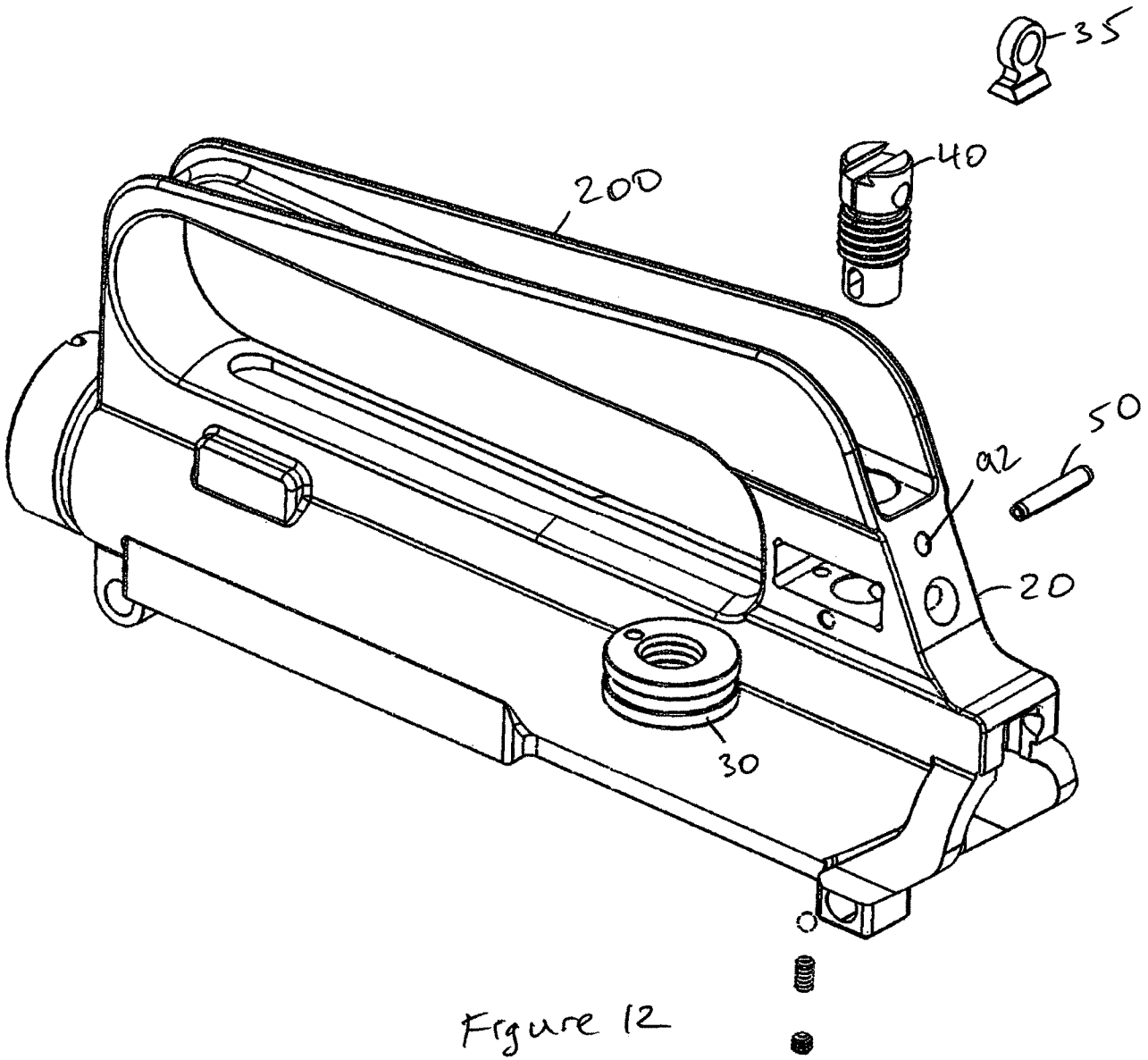
FIG. 12 depicts an exploded view of a rear sight assembly according to some embodiments presently disclosed.
Figure 13:
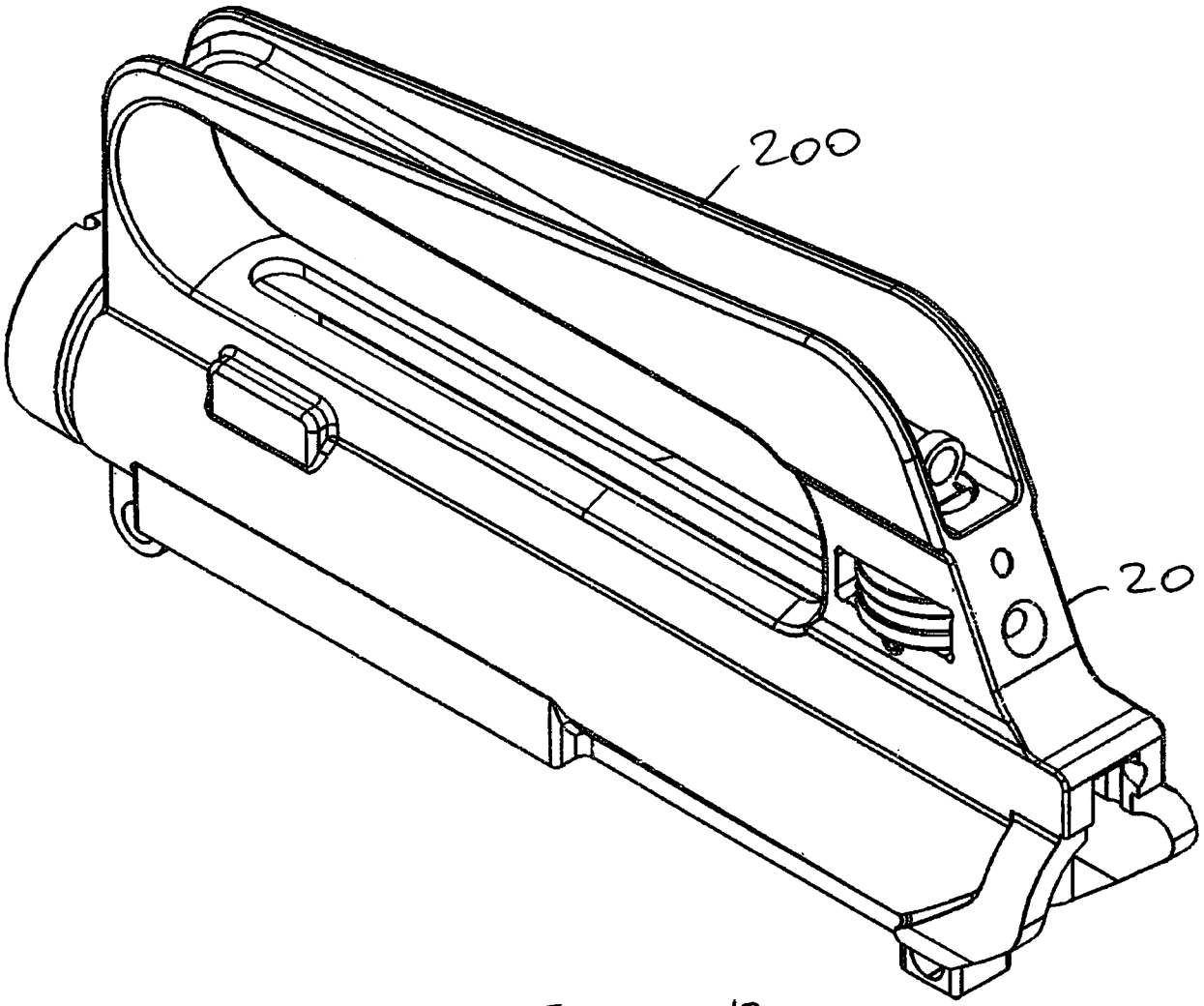
FIG. 13 depicts a perspective view of the rear sight assembly shown in FIG. 12.
Figure 14:
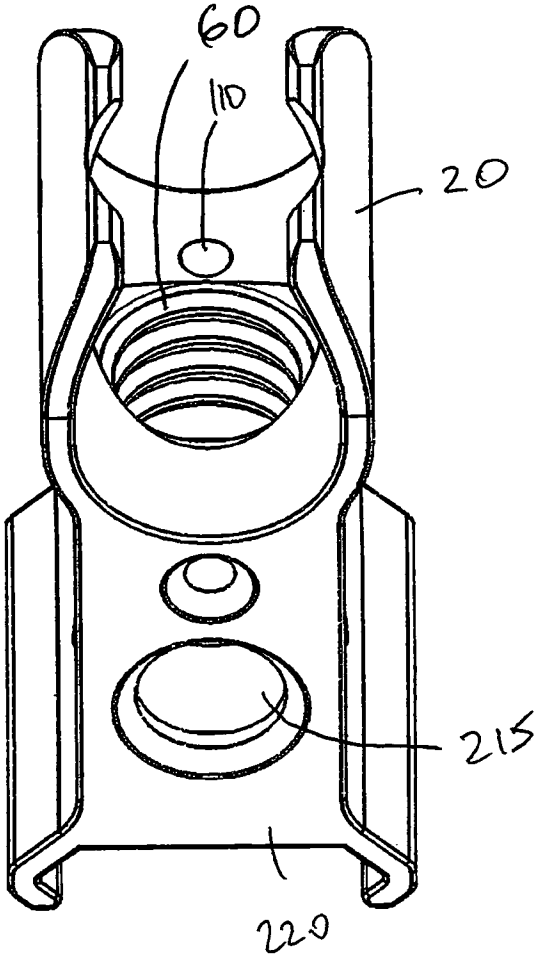
FIG. 14 depicts a housing according to some embodiments presently disclosed.

According to some embodiments presently disclosed, the housing 20 can be coupled with a handle 200 as shown in FIGS. 12-13. According to some embodiments presently disclosed, the housing 20 is integrated into a handle 200 as shown in FIGS. 12-13.

Figure 15:
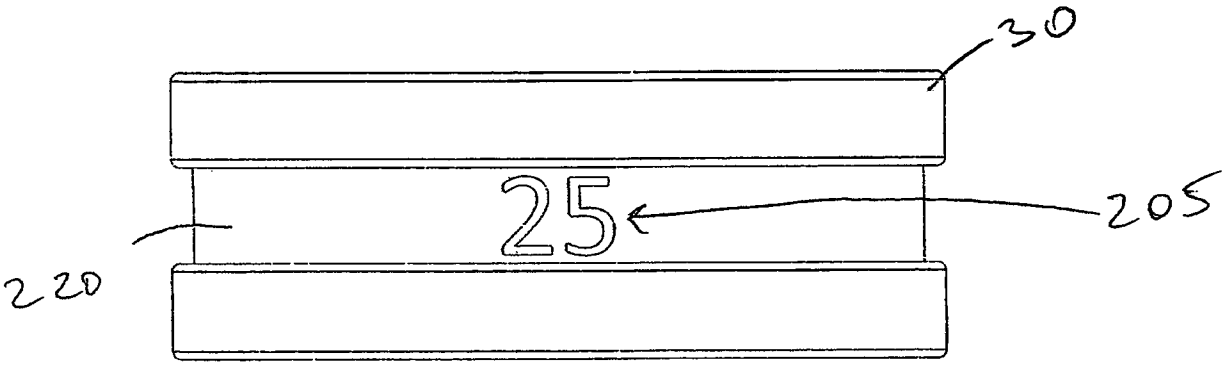
FIG. 15 depicts a thumb wheel according to some embodiments presently disclosed.
Figure 16:
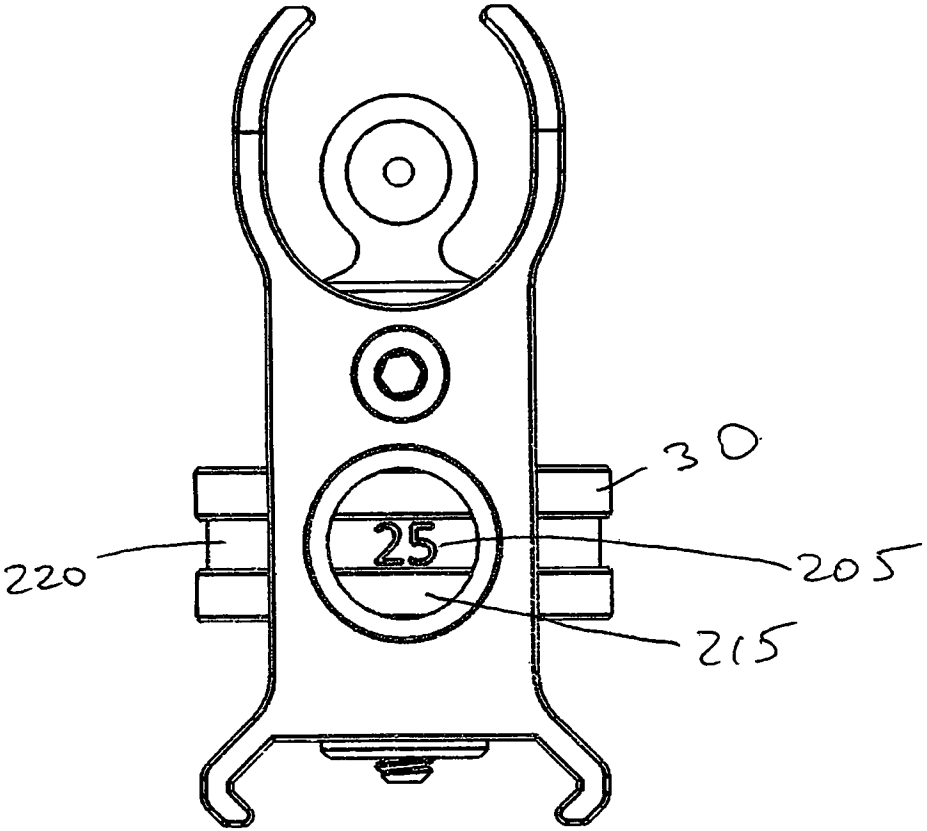
FIG. 16 depicts a front view of a rear sight assembly according to some embodiments presently disclosed.

According to some embodiments presently disclosed, the thumb wheel 30 comprises markings 205 on a side surface 210 representing different elevations (or desired range) as shown in FIG. 15. According to some embodiments presently disclosed, the frame 20 comprises a window opening 215 allowing the user to see the marking 205 as shown in FIG. 16. The window opening 215 is positioned on the side wall 220 of the frame 20 facing the user when the user is firing the firearm 15.

Although the rear sight assembly 10 is shown being applied to an AR type firearm 20 (FIGS. 5-6), it is to be understood that the rear sight assembly 10 can be applied to other types of firearms.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content dearly dictates otherwise. The term "plurality" includes two or more referents unless the content dearly dictates otherwise. Unless defined otherwise, all technical and scientific terms used herein have the same meaning as commonly understood by one of ordinary skill in the art to which the disclosure pertains.

What is claimed is:

1. A removable rear sight assembly comprising:

a housing defining a first opening, a second opening, and a third opening;

a rear sight mechanism comprising:

a thumb wheel positioned in the first opening;

an at least partially threaded support member positioned in the second opening and the third opening, wherein the at least partially threaded support member is threaded through the thumb wheel; wherein the at least partially threaded support member comprises a first section and a second section; and a rear aiming point member adjustably coupled with the at least partially threaded support member; wherein the rear aiming point member is positioned between the first section and the second section; and a fastener; wherein the first section and the second section move closer together when the fastener is rotated in a first direction to prevent the rear aiming point member from moving; wherein the first section and the second section move away from each other when the fastener is rotated in a second direction to allow the rear aiming point member to move.

2. The removable rear sight assembly of claim 1, wherein the housing is a handle for carrying a firearm.

3. The removable rear sight assembly of claim 1, wherein the housing is coupled with a handle for carrying a firearm.

4. The removable rear sight assembly of claim 1, wherein the at least partially threaded support member moves up when the thumb wheel is rotated in a first direction.

5. The removable rear sight assembly of claim 1, wherein the at least partially threaded support member moves down when the thumb wheel is rotated in a second direction.

6. A firearm comprising:

a rear sight assembly integrally coupled with an upper receiver, wherein the rear sight assembly comprises a housing defining a first opening, a second opening, and a third opening;

a thumb wheel positioned in the first opening;

an at least partially threaded support member positioned in the second opening and the third opening, wherein the at least partially threaded support member is threaded through the thumb wheel; wherein the at least partially threaded support member comprises a first section and a second section; and a rear aiming point member adjustably coupled with the at least partially threaded support member; wherein the rear aiming point member is positioned between the first section and the second section; and a fastener; wherein the first section and the second section move closer together when the fastener is rotated in a first direction to prevent the rear aiming point member from moving; wherein the first section and the second section move away from each other when the fastener is rotated in a second direction to allow the rear aiming point member to move.

* * * * *